US008276681B2

(12) United States Patent
Park

(10) Patent No.: US 8,276,681 B2
(45) Date of Patent: Oct. 2, 2012

(54) NIPPER

(76) Inventor: Jeong Yel Park, Goyang-si (KR)

( * ) Notice: Subject to any disclaimer, the term of this patent is extended or adjusted under 35 U.S.C. 154(b) by 317 days.

(21) Appl. No.: 12/673,152

(22) PCT Filed: Sep. 13, 2007

(86) PCT No.: PCT/KR2007/004427

§ 371 (c)(1),
(2), (4) Date: Feb. 11, 2010

(87) PCT Pub. No.: WO2009/022762

PCT Pub. Date: Feb. 19, 2009

(65) Prior Publication Data

US 2011/0308117 A1 Dec. 22, 2011

(30) Foreign Application Priority Data

Aug. 16, 2007 (KR) ..... 10-2007-0082471
Aug. 16, 2007 (KR) ..... 10-2007-0082472

(51) Int. Cl.
*A01B 35/00* (2006.01)

(52) U.S. Cl. ..... 172/40

(58) Field of Classification Search ..... 172/1, 40, 172/56, 272, 554, 699, 165, 667, 735; 405/174, 405/180–183, 271, 303; 404/117, 133.05, 404/133.02; 173/49, 43; 175/55; 37/366, 37/367, 370, 447

See application file for complete search history.

(56) References Cited

U.S. PATENT DOCUMENTS 3,618,237 A * 11/1971 Davis ..... 37/367
4,379,595 A * 4/1983 Roussin et al. ..... 299/37.5
4,453,772 A * 6/1984 Roussin ..... 299/37.5
4,909,333 A * 3/1990 Lindstrom ..... 172/40
7,546,883 B1 * 6/2009 Doering et al. ..... 172/40

* cited by examiner

*Primary Examiner* — Robert Pezzuto
(74) *Attorney, Agent, or Firm* — Mitchell P. Brook; McKenna Long & Aldridge LLP

(57) ABSTRACT

Provided is a vibration-type nipper. The vibration-type nipper comprises a body including a vibration space and a coupling unit for coupling with a boom positioned at an upper portion or a fixing bracket of heavy equipment, a housing positioned in the vibration space and including a vibrator, a plurality of supporting member to opposite sides of the housing and the body corresponding to the housing and supporting the housing allowing the housing to vibrate, a nipper blade installed on the housing and extending downwards, and vibration-dampening member mounted on the body at an upper portion of the vibration space and distributing vibration generated when the housing collides with the body due to elevation of the housing.

3 Claims, 10 Drawing Sheets

[Fig. 1]
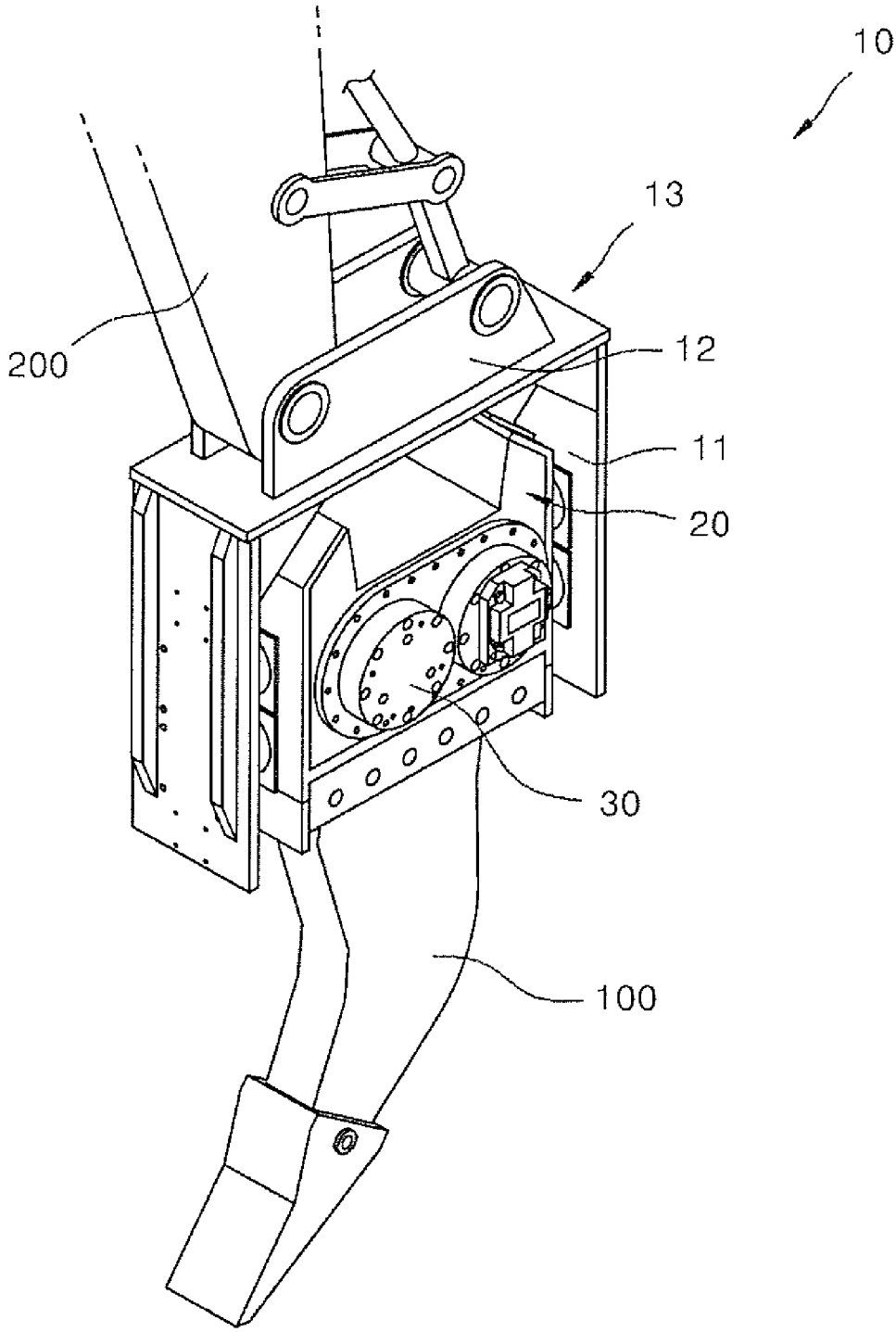

[Fig. 2]
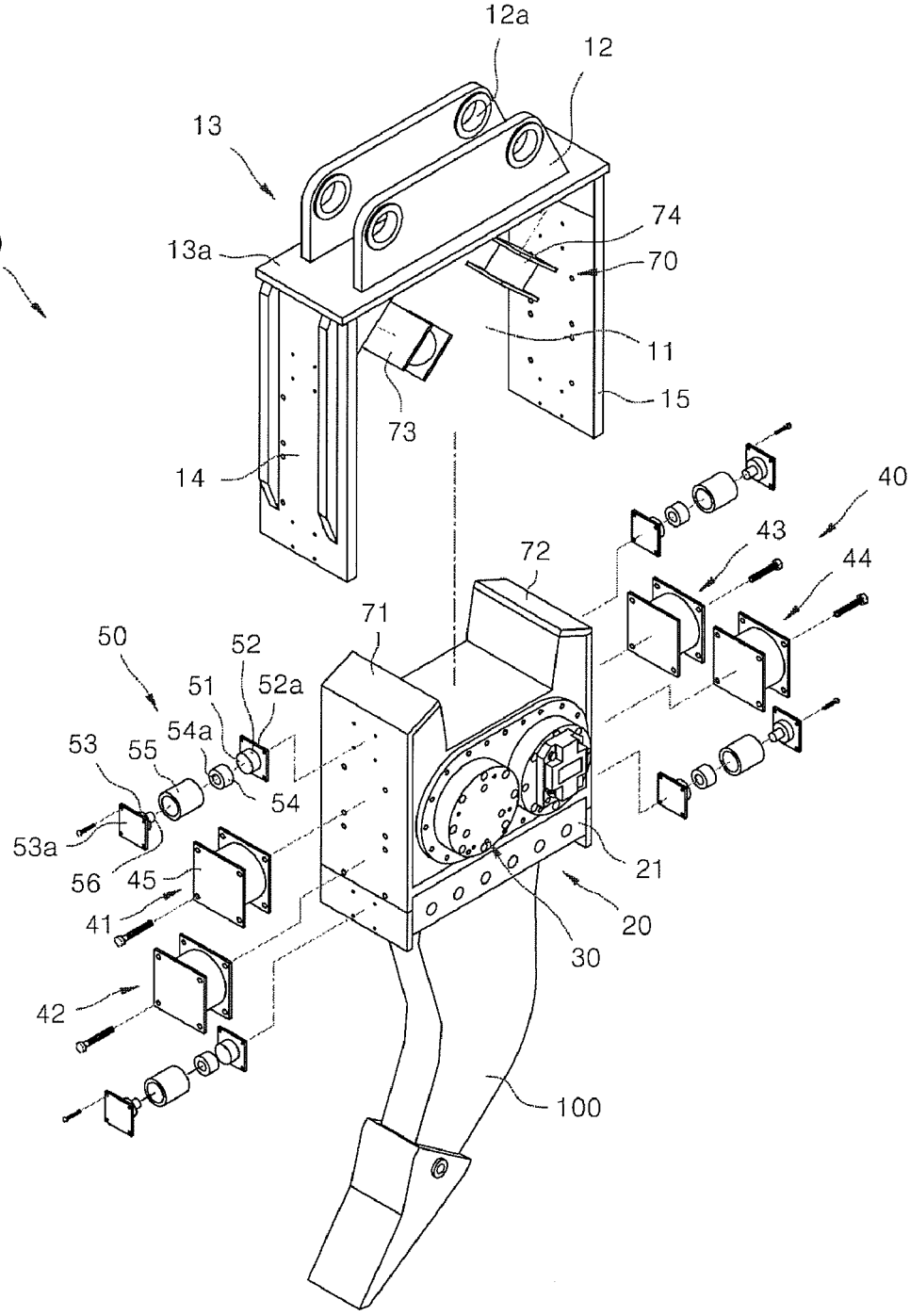

[Fig. 3]
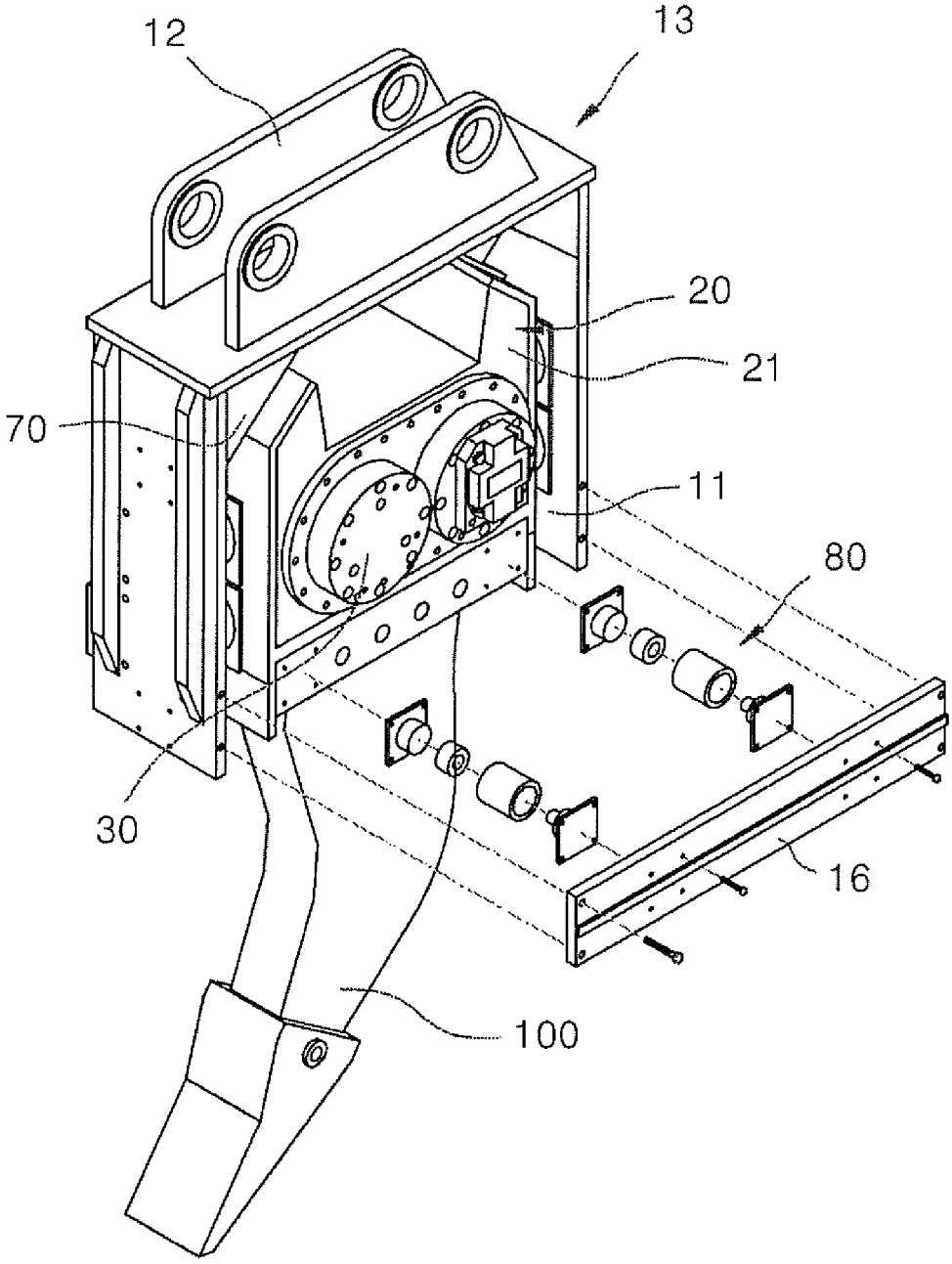

[Fig. 4]
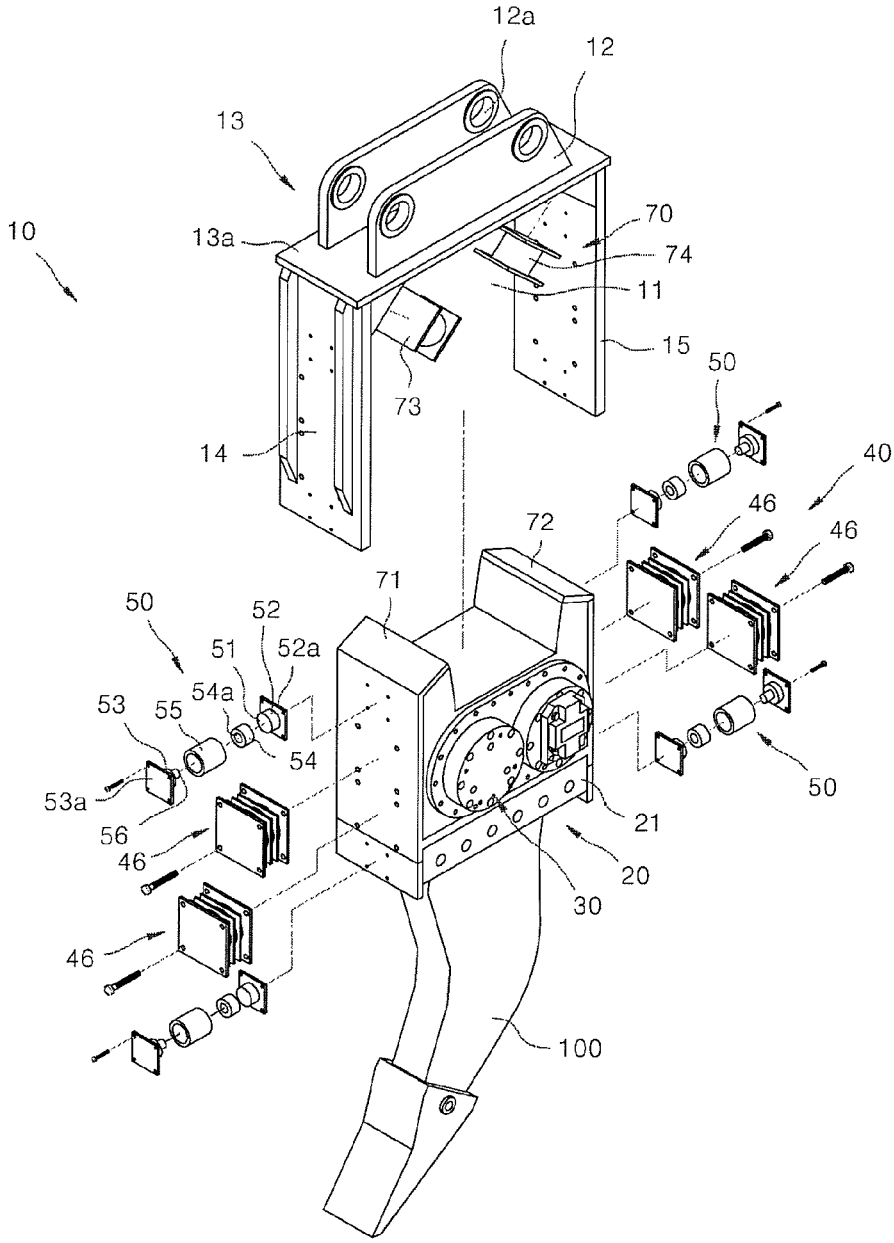
[Fig. 5]
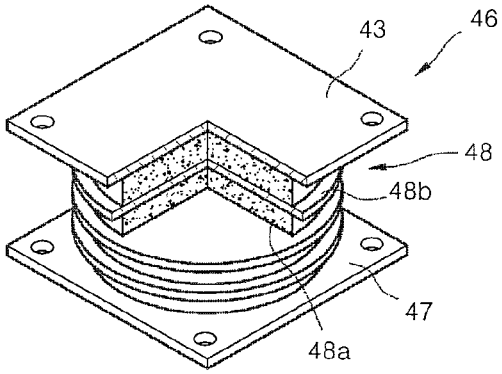

[Fig. 6]
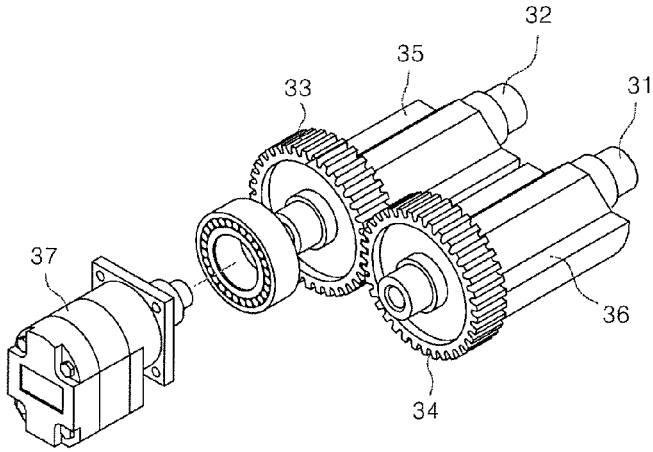
[Fig. 7]
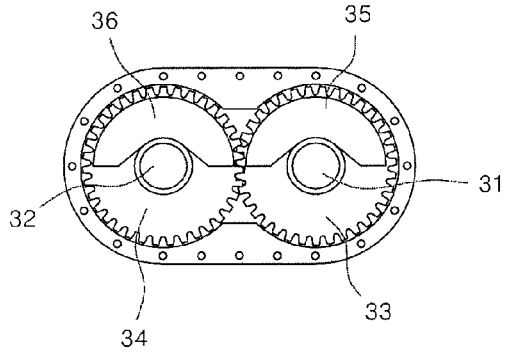
[Fig. 8]
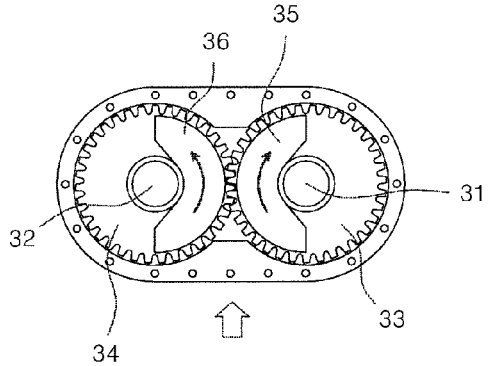
[Fig. 9]
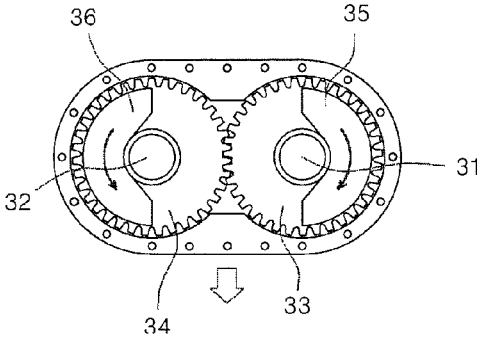

[Fig. 10]
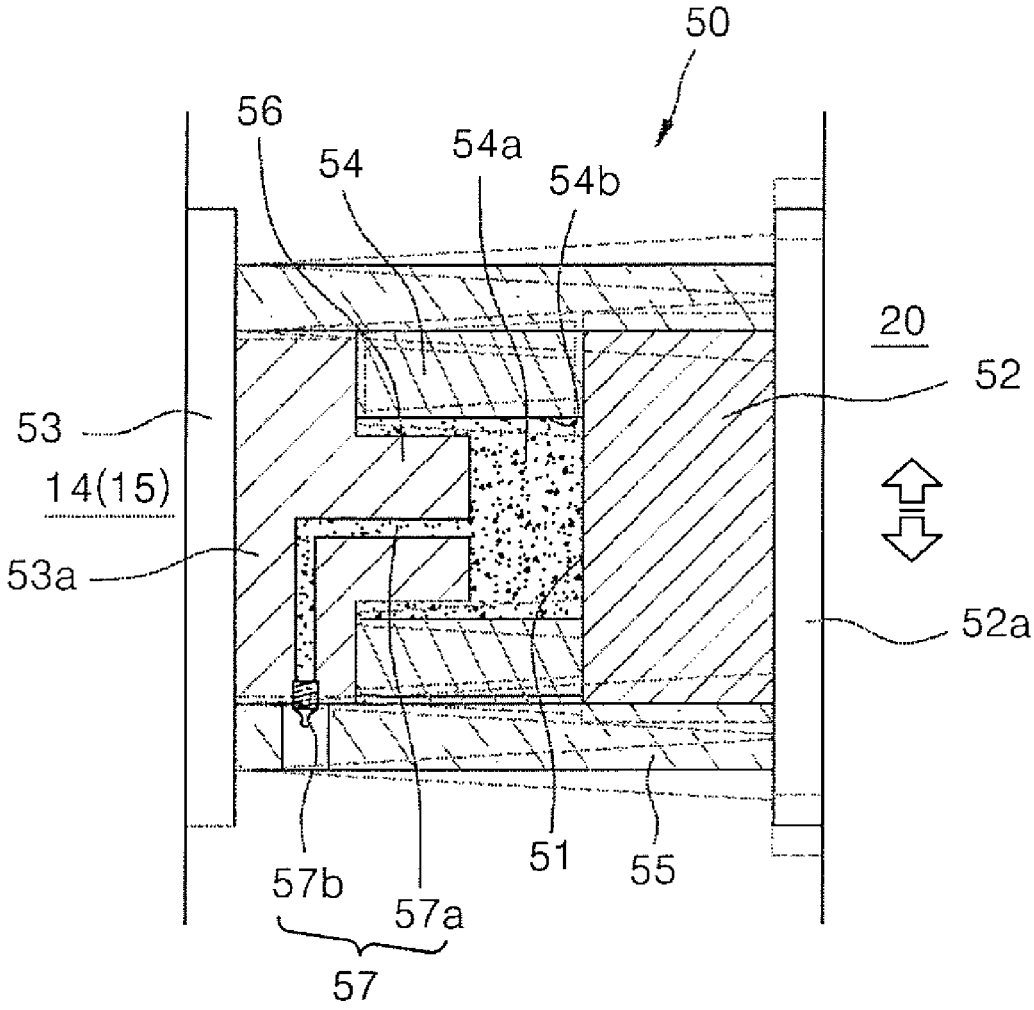

[Fig. 11]
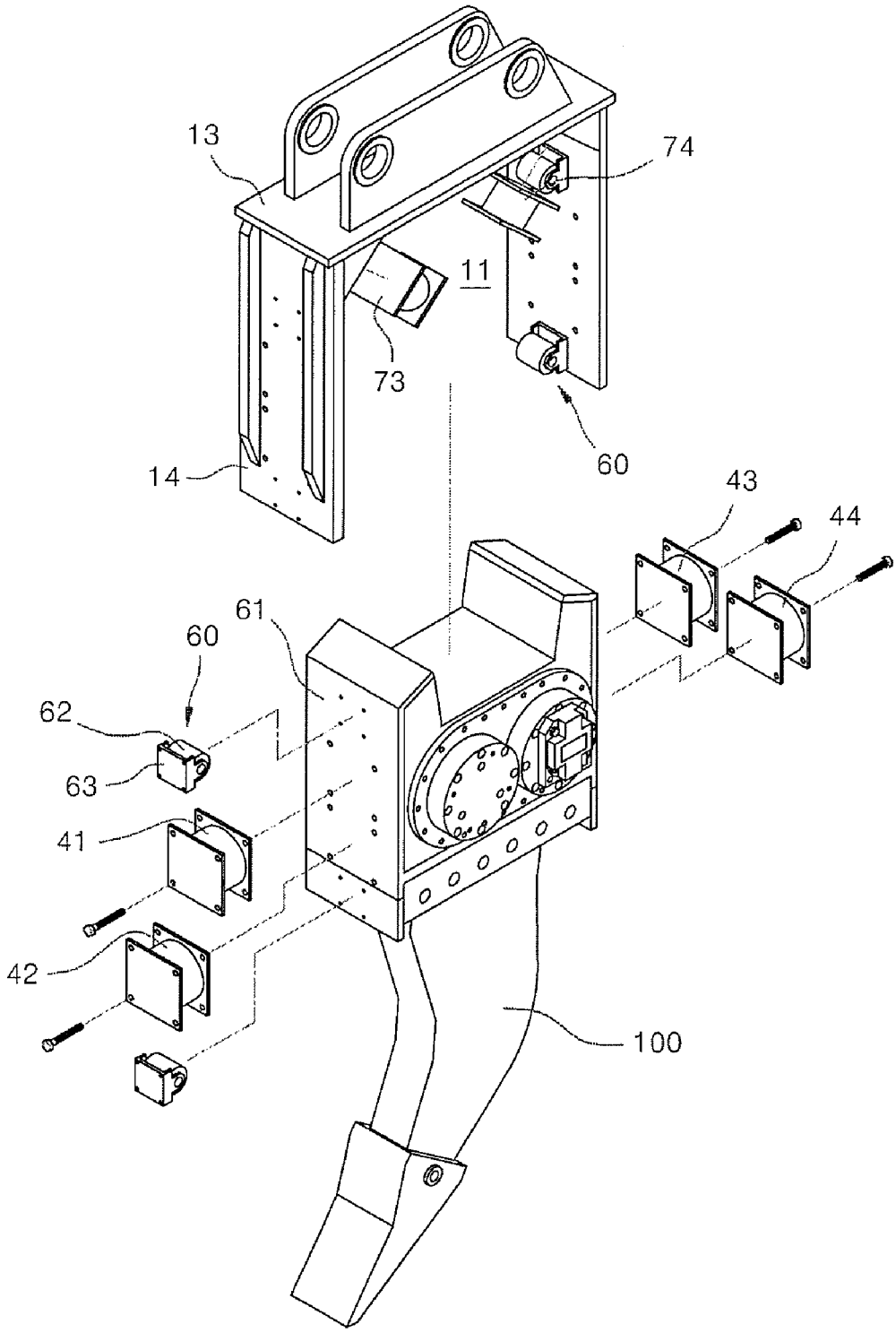

[Fig. 12]
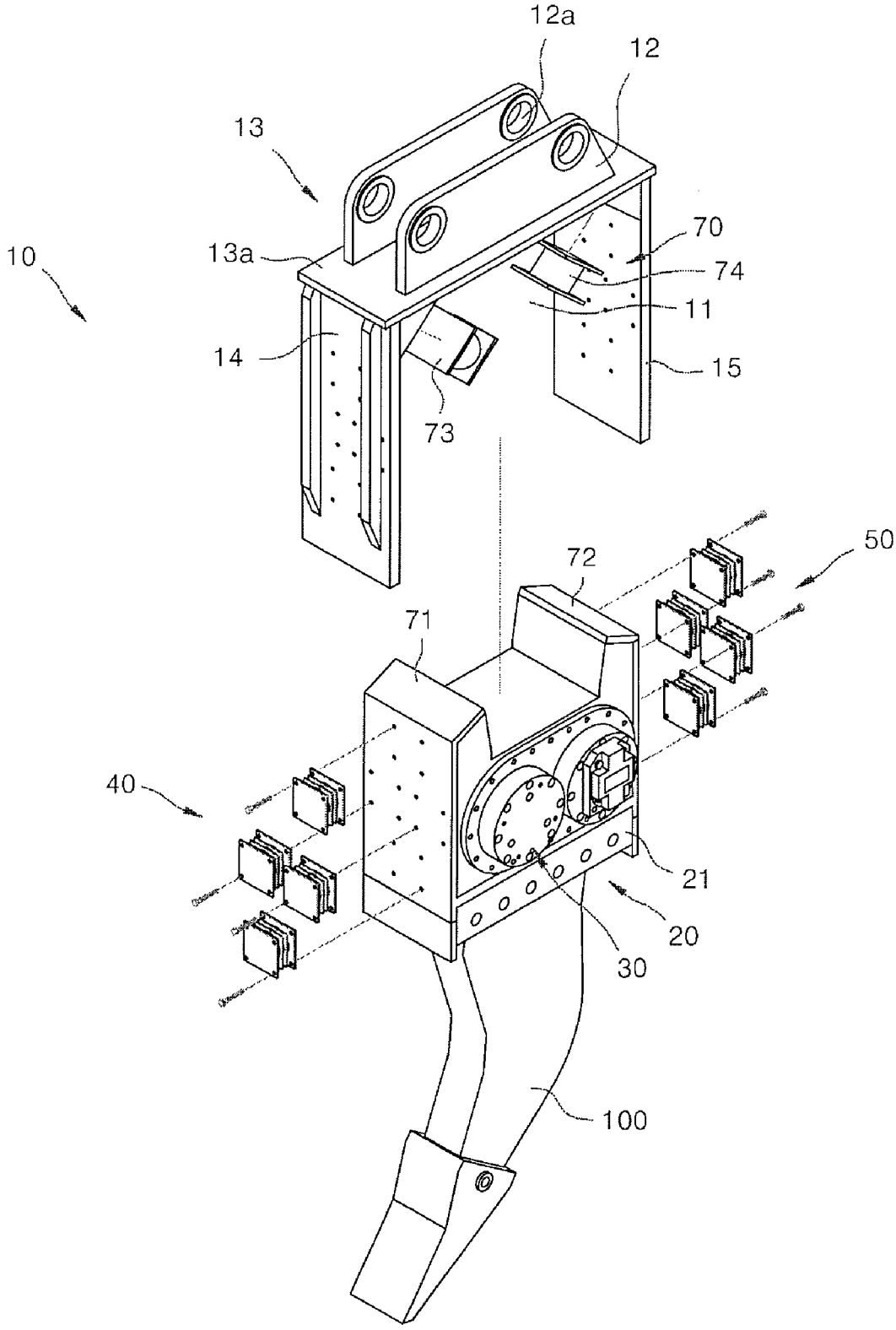

[Fig. 13]
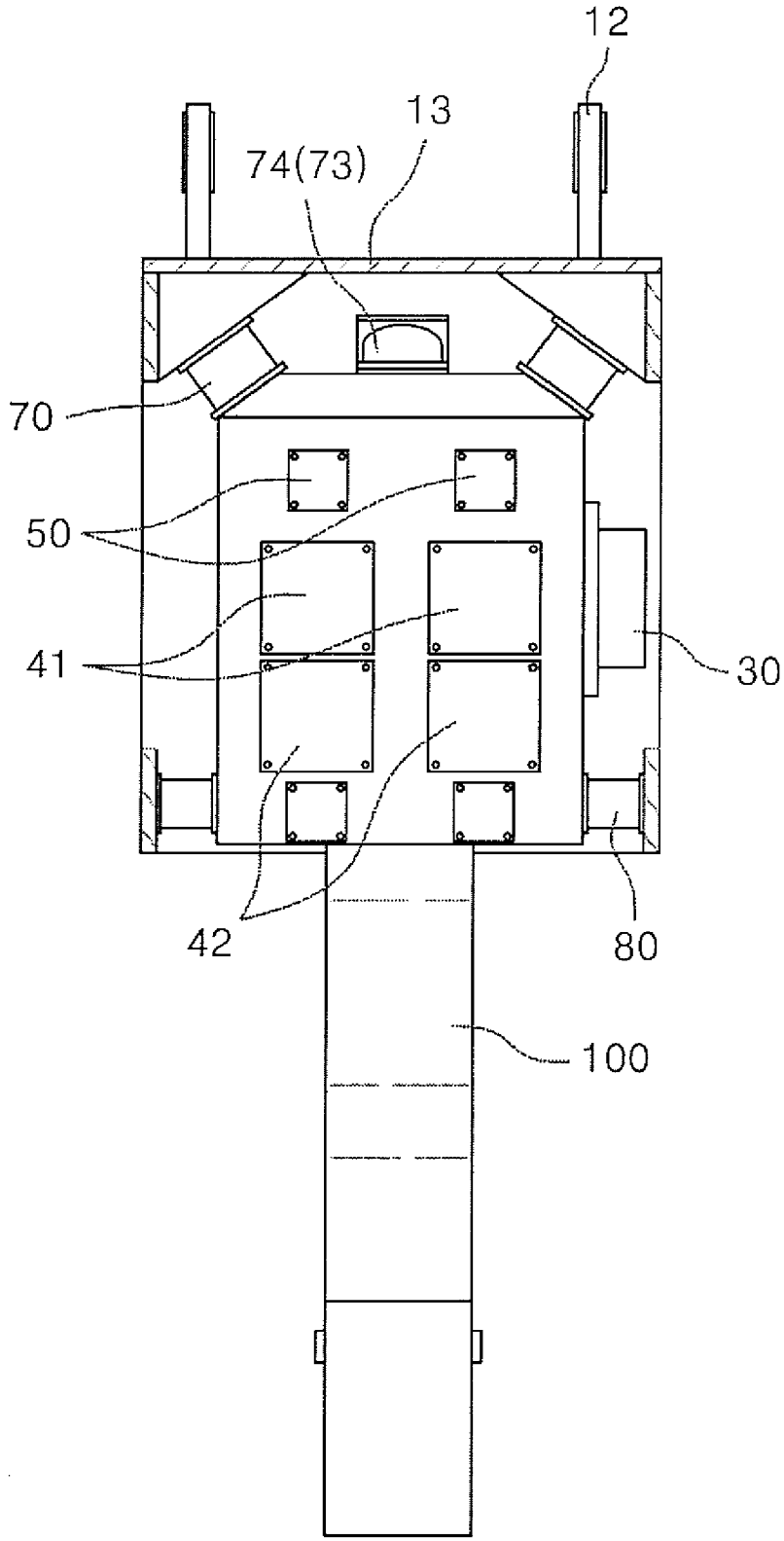

[Fig. 14]
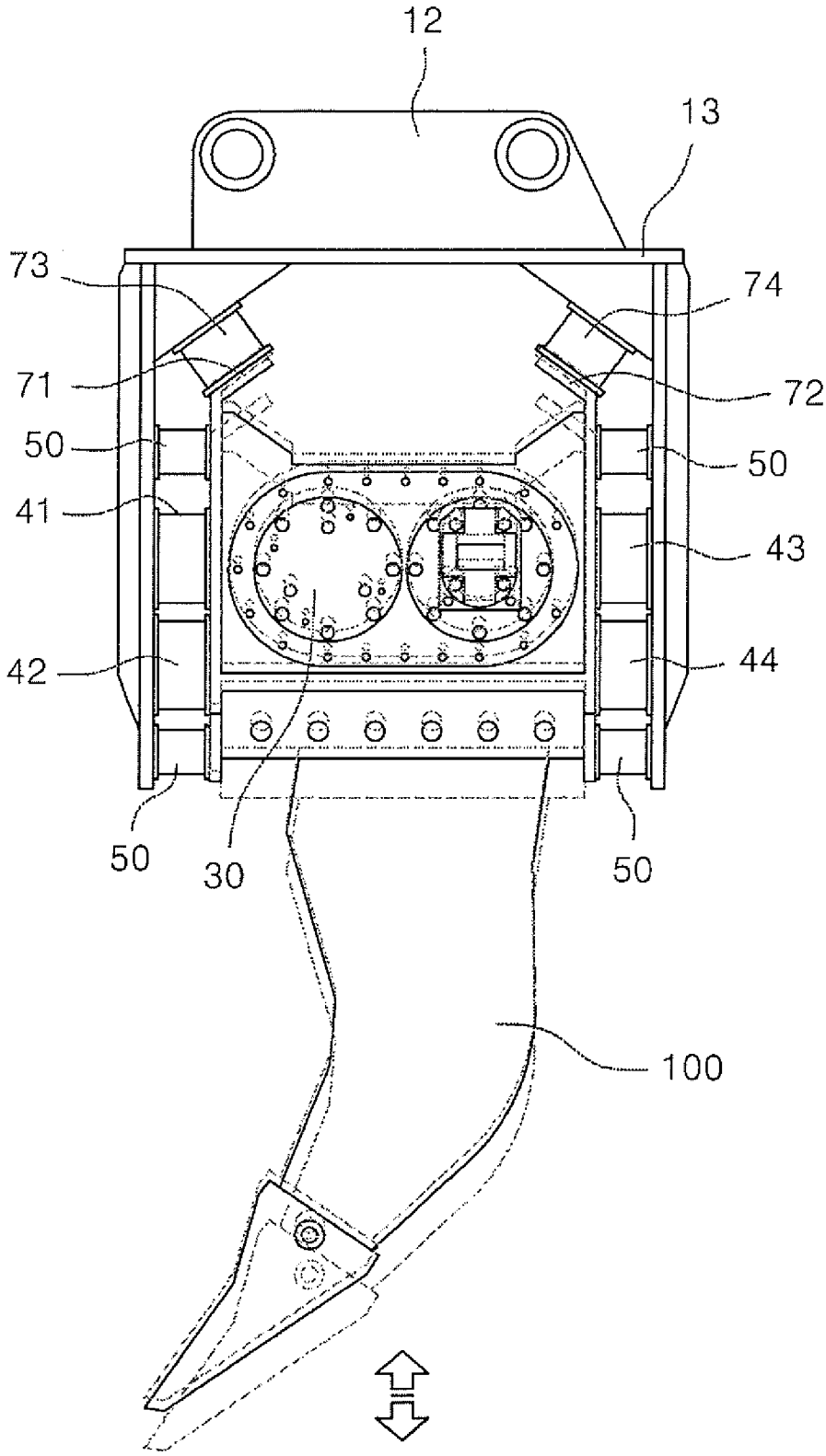

NIPPER

TECHNICAL FIELD

The present invention relates to a vibration-type nipper, and more particularly, to a vibration-type nipper having a nipper unit mounted on heavy equipment, the nipper unit having improved vibration-dampening and supporting structures

BACKGROUND ART

In general, excavators are employed for civil engineering and construction for highways, harbors, bridges, darns, buildings, and urban development, and produce loud noise in the course of compacting, crushing, and digging the ground by ramming, rotating, and drilling operations.

Especially, the excavator has a breaker or a nipper unit mounted on its boom to excavate the base rock, a concrete structure, or the hard ground or rake the soil on the ground. While the excavator is operating, the vibration produced by the breaker or the nipper unit is directly transferred to the boom. Such vibration causes the noise and, as the noise is transferred to the boom, the noise is amplified.

To solve such problems, Korean Laid-open Patent No. 2006-0033893 has disclosed a nipper for an excavator.

In the disclosed patent, the nipper for an excavator includes a connection mounting unit which is fixedly connected to a boom of the excavator, a blade body which is rotatably connected to the connection mounting unit and is for excavating the soil, and a vibrating unit which provides vibration to the boom of the excavator.

Since the nipper according to the Korean patent has the blade body rotatably mounted on the boom of the excavator and the vibrating unit is installed on the blade body, the vibration is transferred to the boom through the blade body. As such, the vibration transferred to the boom is amplified to cause inconvenience of control of the excavator, and moreover may result in damage on the excavator.

DISCLOSURE OF INVENTION

Technical Problem

To solve the above problems, it is an object of the present invention to provide a vibration-type nipper which can prevent vibration produced by a vibration generating unit for vibrating a nipper blade from being transferred to a boom or a body.

It is another object of the present invention to provide a vibration-type nipper which can prevent damage on its equipment when a bending moment or a rotational moment is applied to a nipper blade.

It is still another object of the present invention to provide a vibration-type nipper which can increase friction capacity of a body and housing against the vibration of a vibrator when a bending moment or a rotational moment is applied.

Technical Solution

According to an aspect of the present invention, there is provided a vibration-type nipper comprising a body including a vibration space and a coupling unit for coupling with a boom positioned at an upper portion or a fixing bracket of heavy equipment, a housing positioned in the vibration space and including a vibrator, a plurality of supporting means supported to opposite sides of the housing and the body corresponding to the housing and supporting the housing allowing the housing to vibrate, a nipper blade installed on the housing and extending downwards, and vibration-dampening means mounted on the body at an upper portion of the vibration space and distributing vibration generated when the housing collides with the body due to elevation of the housing.

The vibration-type nipper further comprises a plurality of friction supporting means supporting the housing against the body when a bending moment or a rotational moment is applied to the housing that supports the nipper blade vibrating relative to the body.

Each of the friction supporting means includes a first member having a friction surface, a second member mounted at a place corresponding to the friction surface of the first member, a friction member supported to the second member and having a lubricant storage space, and an elastic member surrounding and supporting the first and second members. Here, each of the friction supporting means further comprises lubricant providing means formed on at least one side of the first member and the second member providing lubricant to the lubricant storage space.

The friction supporting means include guide rollers installed at opposite sides of the body corresponding to the housing, and guide rails installed at opposite sides of the housing corresponding to the body and guiding the rollers in contact with the rollers.

The vibration-dampening means is configured such that sloping portions are formed at opposite sides of the housing and impact dampener members are installed on the body inside of the vibration space corresponding to the housing, the impact dampener members installed with an inclination corresponding to that of the sloping portions.

BRIEF DESCRIPTION OF THE DRAWINGS

FIG. 1 is a perspective view of a vibration-type nipper according to an embodiment of the present invention;

FIG. 2 is an exploded perspective view of the vibration-type nipper in FIG. 1;

FIGS. 3 and 4 are exploded perspective views of modified examples of the vibration-type nipper according to an embodiment of the present invention;

FIG. 5 is a partly cut-away perspective view showing vibration-dampening means of the vibration-type nipper in FIG. 1;

FIG. 6 is a schematic perspective view of a vibrator of the vibration-type nipper according to the present invention;

FIGS. 7 to 9 are views showing an operating state of the vibrator in FIG. 6;

FIG. 10 is a partly cut-away cross-sectional view showing friction supporting means;

FIGS. 11 and 12 are exploded perspective views of a vibration-type nipper according to another embodiment of the present invention;

FIG. 13 is a cross-sectional view of a vibration-type nipper according to still another embodiment of the present invention; and FIG. 14 is a side view illustrating an operating state of the vibration-type nipper in FIG. 13.

BEST MODE FOR CARRYING OUT THE INVENTION

A vibration-type nipper according to the present invention is mounted on an arm or a boom of heavy equipment, such as an excavator, a bulldozer, or a payloader, to compact, excavate or crush concrete, asphalt, and the soft ground. FIGS. 1 to 3 are views of a vibration-type nipper 10 according to an embodiment of the present invention.

Referring to FIGS. 1 to 3, the vibration-type nipper 10 includes a body 13, a vibration unit 20 and a plurality of supporting means 40. The body 13 has a vibration space 11 and includes a fixing brackets 12 at an upper portion to connect with a boom 200 or an arm of heavy equipment. The vibration unit 20 is positioned in the vibration space 11, and has a vibrator 30 installed thereat. The plurality of supporting means 40 are supported to opposite sides of a housing 21 of the vibration unit 20 and the body 13 corresponding to the housing 21, and support the vibration unit 20, allowing the vibration unit 20 to vibrate. The vibration-type nipper 10 further includes a nipper blade 100, a nipper blade 100, and a plurality of friction supporting means 50. The nipper blade 100 is installed on the housing 21 and extends downwards. The vibration-dampening means 70 is positioned on the body 13 at an upper portion of the vibration space 11 to distribute vibration when the housing 21 collides with the body 13 due to elevation of the vibration unit 20. The plurality of friction supporting means 50 support the housing 21 against the body 13 when a bending moment or a rotational moment is applied to the housing 21 supporting the nipper blade 100 vibrating relative the body 13.

The elements of the vibration-type nipper 10 will be described in detail below.

Fixing brackets 12, which is formed on an upper portion of the body 13 of the vibration-type nipper 10, fix the boom 200 or arm of heavy equipment, and include a plurality of coupling holes 12*a* for pin-connection with the boom 200. The vibrating space 11 is formed on the body 13 in such a manner that a first supporting unit 14 and a second supporting unit 15 extend to opposite sides from a base unit 13*a* on which the fixing brackets 12 are mounted and the lower parts thereof are open to allow the nipper blade 100 to be withdrawn downward. As shown in FIG. 3, a supporting frame 16 is preferably installed on each of the front and rear sides of the vibration space 11 to support the front and rear sides of the vibration space 11. The body 13 is not limited to the structure illustrated in the present embodiment, and any structure can be employed as long as with the structure, the vibration unit 20 having the nipper blade 100 installed thereon can smoothly vibrate.

The supporting means 40 suspends the vibration unit 20 in the vibration space 11 of the body 13 so that the vibration unit 20 is smoothly supported, and includes vibration-dampening members 41, 42, 43, and 44, interposed between first side of the housing 21 of the vibration unit 20 and the second side of the housing 21 of the vibration unit 20, the first side corresponding to the first supporting unit 14 of the body 13, and the second side corresponding to the second supporting unit 15 of the body 13. Support plates 45 are disposed at opposite sides of each of the vibration-dampening members 41, 42, 43, and 44 to be fixed to lateral surfaces of the housing 21 or the first and second supporting units 14 and 15. The vibration-dampening members 41, 42, 43, and 44 may be made of, but not limited to, rubber, and any material can be used for the vibration-dampening members 41, 42, 43, and 44 as long as it can support the vibration unit 20 in an elastic manner. For example, the vibration-dampening members 41, 42, 43, and 44 may be made of coil springs or links. When the vibration-dampening members 41, 42, 43, and 44 are made of links, a dampener member may be installed at a hinge-connection portion to absorb a distance difference between a body and a housing due to pivotal movement of the links.

FIGS. 4 and 5 are views showing modified examples of a vibration-dampening member according to the present invention.

Referring to FIGS. 4 and 5, the vibration member 46 includes supporting plates 47 installed at opposite sides thereof to support the vibration-dampening member 46, and a vibration-dampening portion 48 having vibration-dampening rubbers 48*a* and supporting boards 48*b* alternately provided between the supporting plates 47.

The vibration unit 20 vibrates in a state in which it is suspended by the body 13 and includes a vibrator 30 installed on a housing 21, and a nipper blade 100 installed on the housing 21 and protruding downward from a vibration space.

As shown in FIGS. 6 to 9, the vibrator 30 includes a pair of rotation shaft 31 and 32 installed on the housing 21, driving gears 33 and 34 mounted on the rotation shaft 31 and 32, respectively, and engaged therewith, eccentric weight members 35 and 36 installed on the rotation shaft 31 and 32, respectively, and a hydraulic motor 37 installed at the housing 21 to drive the rotation shaft 31 installed on one side of the housing 21. As shown in FIG. 8, the eccentric weight members 35 and 36 are preferably configured such that they overlap between the rotation shafts 31 and 32. Therefore, electricity is produced in the same direction with the rotation shafts 31 and 32 to apply vibration up and down during rotation of the rotation shafts 31 and 32.

The vibrator 30 is not limited to the structure illustrated in the embodiment described above, but it can have any structure as long as the structure allows the nipper blade 100 to vibrate up and down.

The fiction supporting means 50 support the vibration-type nipper blade 100 against the body 13 when a bending moment or a rotational moment is applied to the housing 21, and its embodiments are shown in FIGS. 2 to 4 and 10.

Referring to FIGS. 2 to 4 and 10, the friction supporting means 50 are interposed between the first supporting unit 14 and the housing 21 and between the second supporting unit 15 and the housing 21. Each of the friction supporting means 50 includes a first member 52 with a friction surface 51, a second member 53 positioned corresponding to the friction surface 51 of the first member 52, a friction member 54 supported to the second member 53 and having a lubricant storage space 54*a*, and an elastic member 55 surrounding and supporting the first and second members 52 and 53. Here, the first member 52 may include a first fixing unit 52*a* fixed to the first supporting unit 14 or the second supporting unit 15. The second member 53 may include a second fixing unit 53*a* fixed to a housing corresponding to the first supporting unit 14 or a housing corresponding to the second supporting unit 15. Fixing of the friction member 54 to the first member 52 is performed by forming a supporting projection 56 at an end of the second member 53 so as to have a step difference and inserting the supporting projection 56 into a hollow cavity 54*b* of the friction member 54.

Lubricant providing means 57 for supplying lubricant to the lubricant storage space 54*a* is further provided on at least one side of first and second members 52 and 53. The lubricant providing means 57 includes a passage portion 57*a* penetrating the elastic member 55 to be led to the lubricant storage space 54*a*, that is, a space between the first and second members 52 and 53, and a grease nipple 57*b* installed at an entrance side of the passage portion 57*a*.

FIG. 11 is a view showing a modified example of the friction supporting means according to the present invention.

Referring to FIG. 11, the friction supporting means 60 includes a guide unit 61 and a pair of supporting rollers 62. The guide unit 61 is formed at opposite sides of the vibration unit 20, that is, at the housing 21 corresponding to the first and second supporting units 14 and 15. The pair of supporting rollers 62 are installed at the first and second supporting units 14 and 15, respectively, and are brought into touch with the guide unit 61 of the housing 21 to support the housing 21 when a bending moment or a rotational moment is applied to the vibration unit 20. Also, each of the supporting rollers 62 is rotatably supported to a bracket 63 mounted on the first supporting unit 14 or the second supporting unit 15. Preferably, rubber may be coated on an outer surface of the supporting roller 62 to reduce impact when the supporting roller 62 comes into contact with the guide unit 61.

Referring to FIG. 12, the friction supporting means 50 may be formed of the vibration-dampening members 46 shown in FIG. 5.

Referring back to FIG. 3, in order to guide back-and-forth vibration of the housing 21, auxiliary friction supporting means 80 may be installed between the supporting frame 16 positioned in front of the body 13 and the housing 21 and between a supporting frame (not shown) positioned in rear of the body 13 and the housing 21. The supporting frames connect the first and second supporting units 14 and 15 of the body 13. The auxiliary friction supporting means 80 has substantially the same structure as the friction supporting means 60, and thus a detailed description thereof will be omitted.

The vibration-dampening means 70 operates to prevent vibration produced by the vibration unit 20 or the vibration from being transferred from the vibration unit 20 to the boom 200 or an arm when the vibration unit 20 comes into contact with the body 13 at the upper portion of the vibration space 11 due to vibration of the vibration unit 20 vibrates or excavation of the nipper blade 100. To this end, sloping portions 71 and 72 are formed at opposite sides of the housing 21 and vibration dampener members 73 and 74 are installed at opposite sides of the body 13 corresponding to the housing 21, the vibration dampener member 70 of the vibration-dampening means 70 is installed at front and rear and right and left corners of the housing 21. The vibration-dampening means 70 may be formed with an inclination, as shown in FIG. 13.

The vibration-dampening members 73 and 74 may be made of rubber or synthetic resin. However, the structure of the vibration-dampening means 70 is not limited to the illustrated example of the present embodiment, and any structure can be employed as long as it can distribute the upward vibration to prevent vibration from being applied in a perpendicular direction.

The operation of the vibration-type nipper according to the present invention will be described below.

According to the present invention, the vibration-type nipper performs crushing and excavation operations at an engineering, construction, demolition site or the like on concrete, asphalt, soft stone, or wind stone, which is relatively stronger than ordinary soil, minimizes noises generated during the crushing and excavation operations and prevents vibration from being transferred to a boom or an arm.

That is to say, in a state in which the vibration-type nipper 10 according to the present invention is mounted on the boom 100 of an excavator, if the hydraulic motor 37 of the vibrator 30 is driven, the rotation shaft 31 and 32 rotate and the eccentric weights 35 and 36 installed thereon rotate accordingly, thereby producing vibration. In this state, the eccentric directions of the eccentric weights 35 and 36 are applied in radial directions corresponding to the rotation shaft 31 and 32. Thus, during rotation, the eccentric weights 35 and 36 are positioned between the rotation shaft 31 and 32 or corresponding outer positions of the rotation shaft 31 and 32 (see FIGS. 8 and 9). Therefore, primary vibration produced by the vibration unit 20, that is, the housing 21 and the nipper blade 100 connected to the housing 21, is applied up and down.

During this process, since the housing 21 of the vibration unit 20 is suspended by the vibration-dampening members 41 to 44 of the supporting means 40 which are made of rubber having elasticity, the housing 21 is not interfered by the vibration applied up and down. Especially, when the housing 21 of the vibration unit 20 vibrating up and down collides with the body 13 due to elevation of the housing 21, impacts generated when the housing 21 of the vibration unit 20 collides with the body 13 are distributed by the vibration-dampening means 70 and thus the vibration is prevented from being directly transferred to the boom 200 coupled with the body 13. The vibration-dampening means 70 is configured such that the sloping portions 71 and 72 are formed at opposite corners of the housing 21 and the vibration-dampening members 73 and 74 are formed at opposite sides of the body 13 at an upper portion of the vibration space 11 corresponding to the housing 21. Accordingly, impacts generated when the sloping portions 71 and 72 of the elevating housing 21 collide with the vibration-dampening members 73 and 74, can be distributed. That is to say, when the sloping portions 71 and 72 collide with the vibration-dampening members 73 and 74 which have sloping surfaces corresponding to the sloping portions 71 and 72, impacts are divided in a longitudinal direction and in a normal direction with respect to the sloping surfaces. The primary vibration derived from the divided impacts is applied substantially in the normal direction. In such a manner, the impacts can be prevented to being transferred directly to the boom 200.

Meanwhile, while the housing 21 of the vibration unit 20, that is, the nipper blade 10, excavates or crushes concrete, asphalt, or soft ground, a bending moment or a rotational moment is applied to the nipper blade 100. At this time, the housing 21 is supported at its opposite sides against the supporting units 14 and 15 by the friction supporting means 50 without affecting vibration of the housing 21. As shown in FIG. 14, the first and second members 52 and 53 of the friction supporting means 50 are respectively supported to the housing 21 and the first and second supporting members 14 and 15 and the friction member 54 supported on the second member 53 is in contact with the friction surface 51 of the first member 52. Thus, the housing 21 can be supported without being interfered by the vibration of the housing 21 due to sliding contact between the friction surface 51 and the friction member 54.

In addition, the auxiliary friction supporting means 80 are installed on the supporting frames 16 and 17 mounted on the main board 13 to guide the vibration in back and forth directions, and hence can support the housing 21 in back and forth directions.

According to the present invention, a vibration-type nipper mounted on heavy equipment can minimize vibration transferred to a boom or an arm of the heavy equipment, such as an excavator or a payloader. In addition, the vibration-type nipper according to the present invention can increase the force of supporting a housing against a body when a rotational or bending moment is applied to a nipper blade. Further, the vibration-type nipper according to the present invention can prevent supporting means for supporting the housing against the body, e.g., vibration-dampening rubber, from being damaged.

INDUSTRIAL APPLICABILITY

As described above, since a vibration-type nipper unit can prevent vibration from being transferred to a boom or an arm during excavation or crushing of a nipper blade, a vibration-type nipper according to the present invention can be widely used for heavy equipment for engineering and construction

The invention claimed is:

1. A vibration-type nipper comprising:

a body including a vibration space and a coupling unit for coupling with a fixing bracket of heavy equipment positioned at an upper portion of the body;

a housing positioned in the vibration space and including a vibrator;

a plurality of supporting means supported to opposite sides of the housing and the body corresponding to the housing and supporting the housing allowing the housing to vibrate;

a nipper blade installed on the housing and extending downwards;

vibration-dampening means mounted on the body at the vibration space and distributing vibration generated when the housing collides with the body due to elevation of the housing; and a plurality of friction supporting assemblies supporting the housing against the body when a bending moment or a rotational moment is applied to the housing that supports the nipper blade vibrating relative to the body, wherein each of the friction supporting assemblies includes a first member having a friction surface, a second member mounted at a place corresponding to the friction surface of the first member, a friction member supported to the second member and having a lubricant storage space, an elastic member surrounding and supporting the first and second members, wherein the vibration-dampening means is configured such that sloping portions are formed at opposite sides of the housing and impact dampener members are installed on the body inside of the vibration space corresponding to the housing, the impact dampener members installed with an inclination corresponding to that of the sloping portions.

2. The vibration nipper of claim 1, wherein the supporting means include supporting plates spaced a predetermined distance apart from each other and a vibration-dampening unit in which vibration-dampening rubber and supporting boards are alternately provided between the supporting plates.

3. The vibration-type nipper of claim 1, further comprising: supporting frames installed on the body to correspond to front and rear surfaces of the housing; and auxiliary friction supporting means installed at the housing and supporting members and preventing the housing from vibrating relative to the body.

* * * * *